US009222731B2

(12) United States Patent
Dinulescu

(10) Patent No.: US 9,222,731 B2
(45) Date of Patent: Dec. 29, 2015

(54) PLATE TYPE HEAT EXCHANGER AND METHOD OF MANUFACTURING HEAT EXCHANGER PLATE

(75) Inventor: Mircea Dinulescu, Voorburg (NL)

(73) Assignee: DINULESCU, Mircea, Voorburg (NL)

( * ) Notice: Subject to any disclaimer, the term of this patent is extended or adjusted under 35 U.S.C. 154(b) by 624 days.

(21) Appl. No.: 13/517,002

(22) PCT Filed: Dec. 17, 2010

(86) PCT No.: PCT/NL2010/050858

§ 371 (c)(1),
(2), (4) Date: Jul. 24, 2012

(87) PCT Pub. No.: WO2011/074963

PCT Pub. Date: Jun. 23, 2011

(65) Prior Publication Data

US 2012/0325445 A1 Dec. 27, 2012

(30) Foreign Application Priority Data

Dec. 18, 2009 (NL) ..... 2003983

(51) Int. Cl.
*F28F 3/08* (2006.01)
*F28D 9/00* (2006.01)
(Continued)

(52) U.S. Cl.
CPC ..... *F28D 9/0037* (2013.01); *B21D 51/52* (2013.01); *B21D 53/04* (2013.01); *F28F 13/06* (2013.01);
(Continued)

(58) Field of Classification Search
CPC ..... F28D 9/0037; F28D 9/0031; B21D 53/04; Y10T 29/4935; Y10T 29/49366; F28F 1/006; F28F 13/06; F28F 3/08
USPC ..... 165/166, 165, 164
See application file for complete search history.

(56) References Cited

U.S. PATENT DOCUMENTS 1,775,103 A * 9/1930 Hume ..... 165/166
2,586,118 A * 2/1952 Teller ..... 165/130
(Continued)

FOREIGN PATENT DOCUMENTS

AT 404877 B * 3/1999
CH 692760 A5 10/2002
(Continued)

OTHER PUBLICATIONS

Copy of International Preliminary Report on Patentability for PCT/NL2010/050858 dated Jun. 19, 2012.
(Continued)

*Primary Examiner* — Tho V Duong
*Assistant Examiner* — Aaron Isenstadt
(74) *Attorney, Agent, or Firm* — Hoyng Rokh Monegier LLP; Minerva Rivero; David P. Owen

(57) ABSTRACT

The invention relates to a heat exchanger plate (106) having first surface portions (210) located along first plate edges (220) and comprising first contacting regions (214), and second surface portions (212) located along second plate edges (222). The first surface portions (210) are bent to a first side yielding a first partial fluid channel (230), and the second surface portions (212) are bent to a second side yielding a second partial fluid channel (232). The first contacting regions (214) define a plane (S). The heat exchanger plate (106) has corner surface portions (224) comprising first corner edge portions (226) and second corner edge portions (228). At least two corner surface portions (224) are bent inward with respect to the first partial fluid channel (230) such that their first corner edge portions (226) are in the plane (S), while their second corner edge portions (228) are perpendicular to the plane (S).

16 Claims, 6 Drawing Sheets

(51) Int. Cl.

| | |
|---|---|
| ***B21D 51/52*** | (2006.01) |
| ***B21D 53/04*** | (2006.01) |
| ***F28F 13/06*** | (2006.01) |
| ***F28F 19/00*** | (2006.01) |
| *B21D 53/02* | (2006.01) |
| *F28F 1/00* | (2006.01) |
| *F28F 9/22* | (2006.01) |

(52) U.S. Cl.

CPC ..... *F28F 19/002* (2013.01); *F28F 1/006* (2013.01); *F28F 2009/222* (2013.01); *F28F 2230/00* (2013.01); *F28F 2250/02* (2013.01); *F28F 2275/04* (2013.01); *F28F 2275/06* (2013.01); *F28F 2275/08* (2013.01); *Y10T 29/4935* (2015.01)

(56) References Cited

U.S. PATENT DOCUMENTS

| | | | | | |
|---|---|---|---|---|---|
| 4,099,928 | A * | 7/1978 | Norback | 29/890.039 |
| 4,378,837 | A * | 4/1983 | Ospelt | 165/166 |
| 4,442,886 | A | 4/1984 | Dinulescu | |
| 5,072,790 | A * | 12/1991 | Lapowsky | 165/166 |
| 5,228,515 | A * | 7/1993 | Tran | 165/166 |
| 5,383,516 | A | 1/1995 | Dinulescu | |
| 5,494,100 | A | 2/1996 | Peze | |
| 5,699,856 | A * | 12/1997 | Merle | 165/166 |
| 6,378,604 | B1 * | 4/2002 | Feind et al. | 165/166 |
| 6,663,694 | B2 * | 12/2003 | Hubbard et al. | 95/288 |
| 6,802,365 | B2 * | 10/2004 | Huguet et al. | 165/166 |
| 2003/0093900 | A1 | 5/2003 | Huguet et al. | |
| 2003/0116305 | A1 | 6/2003 | Beddome et al. | |
| 2004/0080060 | A1 | 4/2004 | Mockry et al. | |
| 2005/0061493 | A1 * | 3/2005 | Holtzapple | 165/157 |
| 2010/0006274 | A1 * | 1/2010 | Cho | 165/166 |

FOREIGN PATENT DOCUMENTS

| | | | | |
|---|---|---|---|---|
| EP | 0874210 | A2 | | 10/1998 |
| EP | 874210 | A2 | * | 10/1998 |
| EP | 0984238 | A2 | | 3/2000 |
| EP | 1842616 | A2 | | 10/2007 |
| FR | 352634 | A | * | 8/1905 |
| JP | 56168093 | A | * | 12/1981 |
| JP | 63116097 | A | * | 5/1988 |
| JP | 2004092935 | A | | 3/2004 |
| NL | 25173 | | | 4/1931 |
| NL | 25173 | C | | 4/1931 |
| WO | 92/09859 | A1 | | 6/1992 |
| WO | 96/19708 | A1 | | 6/1996 |
| WO | 2009083795 | A2 | | 7/2009 |

OTHER PUBLICATIONS

International Preliminary Report on Patentability for PCT/NL2010/050858 dated Jun. 19, 2012.

International Searching Authority, International Search Report, Sep. 28, 2011, 4 pages.

* cited by examiner

PLATE TYPE HEAT EXCHANGER AND METHOD OF MANUFACTURING HEAT EXCHANGER PLATE

TECHNICAL FIELD

The present invention relates to a heat exchanger plate, to a heat exchanger shell and to a heat exchanger assembly. Furthermore, the invention relates to a method of manufacturing a heat exchanger plate.

BACKGROUND

A conventional plate type heat exchanger generally consists of a plurality of heat exchanger plates, between which fluid streams with a different temperature are allowed to flow in a spatially separated manner. This enables the recovery of heat energy by means of the heat exchanged between the fluids.

From European patent document EP 1,842,616, a method for manufacturing a plate type heat exchanger is known. The resulting heat exchanger comprises a plurality of stacked heat exchanger plates formed from rectangular plate members. Each heat exchanger plate has flanges formed in the periphery of the plate. The flanges comprise flat portions on two opposing edges of the plate, which are bent towards one side of the plate, and bulge portions at the remaining opposing edges of the plate, which are bent toward the other side of the plate. Two heat exchanger plates are connected facing each other with one plate positioned upside down. In an alternating fashion, the flat portions or the bulge portions of adjacent plates constitute contacting surfaces. In this way, gap portions with openings are formed in between the plates, allowing for the fluids to exchange heat while flowing through these gap portions. It can be observed that for the combined heat exchanger plates in EP 1,842,616, a first gap portion or fluid channel is formed having first openings or fluid channel apertures with a hexagonal shape. A similar heat exchanger configuration with hexagonal fluid channel apertures is described in patent document US 2004/0080060.

The disadvantage of the known heat exchangers is that the corners of the irregularly shaped fluid channels of such a heat exchanger introduce undesired obstructions to the flowing fluid in the side corners of the fluid channels, representing a source of turbulence and an increased resistance to the flow. Furthermore, the corner geometry is complex, requiring additional sealing items, and is expensive to fabricate.

SUMMARY

It is an object to provide a heat exchanger plate, such that a pair of these plates is combinable into a heat exchanger shell with a fluid channel aperture having improved connectivity and reduced turbulence properties.

According to an aspect, there is provided a heat exchanger plate, formed from a quadrilateral plate having a pair of opposing first plate edges and a pair of opposing second plate edges, the heat exchanger plate having first surface portions each along a first middle edge portion of a first plate edge, each first surface portion comprising a first contacting region, the heat exchanger plate having second surface portions each along a second middle edge portion of a second plate edge, each second surface portion comprising a second contacting region, whereby the first surface portions are bent to a first side of the quadrilateral plate resulting in a first partial fluid channel, and the second surface portions are bent to a second side of the quadrilateral plate resulting in a second partial fluid channel, whereby the first contacting regions are coplanar defining a plane, and whereby the heat exchanger plate comprises corner surface portions comprising a first corner edge portion and a second corner edge portion, wherein at least two corner surface portions are bent inward with respect to the first partial fluid channel such that the respective first corner edge portions are in the plane, while the respective second corner edge portions are substantially perpendicular to the plane.

In addition and according to another aspect of the invention, there is provided a method of manufacturing such a heat exchanger plate.

The "substantially perpendicular" quality of the respective second corner edge portions indicates that such second corner edge portion is oriented at an angle of substantially 90° with respect to the plane defined by the coplanar first contacting regions.

Advantageously, by joining two such heat exchanger plates with folded corner surface portions into a heat exchanger shell, with one plate upside down and the plates facing each other, a first fluid channel is formed having first fluid channel apertures with a regular quadrilateral or even rectangular shape. A stacking of such heat exchanger shells yields a heat exchanger assembly with first and second fluid channels, in which the first fluid channel apertures are regularly shaped, representing an entrance for supplied fluid flow that is unobstructed and that can be easily fitted to the fluid supply and discharge channels.

According to an embodiment, the heat exchanger plate is formed from a rectangular plate, having a second partial fluid channel that is substantially perpendicular to the first partial fluid channel.

The resulting heat exchanger plate, shell and assembly are highly symmetrical and therefore easy to manufacture.

According to another embodiment, at least one of the first surface portions comprises a first flange near the corresponding first middle edge portion. This first flange includes the first contacting region.

According to a further embodiment, at least one second surface portion comprises a second flange near the corresponding second middle edge portion. This second flange includes the second contacting region These first and second contacting regions of the first and second flange present more substantial contact surfaces for connecting adjacent heat exchanger plates.

According to a further embodiment, a first flange portion of the first flange is bent with respect to the plane S.

The provision of receding flange portions results in a crevice between the contacting first surfaces of heat exchanger plates situated along these flange portions, presenting an accessible region for connecting and/or sealing the heat exchanger plates, for example by brazing or welding.

In a further embodiment, the cross section of at least one of the first and second partial fluid channels varies along the at least one of the first and second partial fluid channels.

By varying the cross sections of the channels along their length, it is possible to adjust the temperature distribution inside the heat exchanger in such a way as to improve the heat transfer efficiency between the heat exchanging fluids flowing through the channels.

According to further aspects of the invention, a plate type heat exchanger shell and a plate type heat exchanger assembly are provided. The heat exchanger shell comprises a pair of heat exchanger plates as described above, in which the heat exchanger plates are connected along the first contacting regions, the first partial fluid channels of the respective heat exchanger plates forming a first fluid channel. The provided plate type heat exchanger assembly comprises a plurality of heat exchanger shells as described above, in which heat exchanger shells are connected along the second contacting regions, such that one of the second partial fluid channels of a first heat exchanger shell combines with one of the second partial fluid channels of a second heat exchanger shell into a second fluid channel.

BRIEF DESCRIPTION OF THE DRAWINGS

Embodiments will now be described, by way of example only, with reference to the accompanying schematic drawings in which corresponding reference symbols indicate corresponding parts, and in which.

The figures are only meant for illustrative purposes, and do not serve as restriction of the scope or the protection as laid down by the claims.

DETAILED DESCRIPTION

This invention relates to heat exchangers and to a method of manufacturing heat exchanger plates forming a heat exchanger shell or assembly. Plate type heat exchangers may be formed of a plurality of heat exchanger plates having bent or folded surface portions. The "bending" and "folding" of surfaces should be broadly interpreted here, not only referring to a sharply defined crease along a line on this surface, but also to a more gradually curved surface region.

We turn now to a more detailed discussion of the figures.

Figure 1:
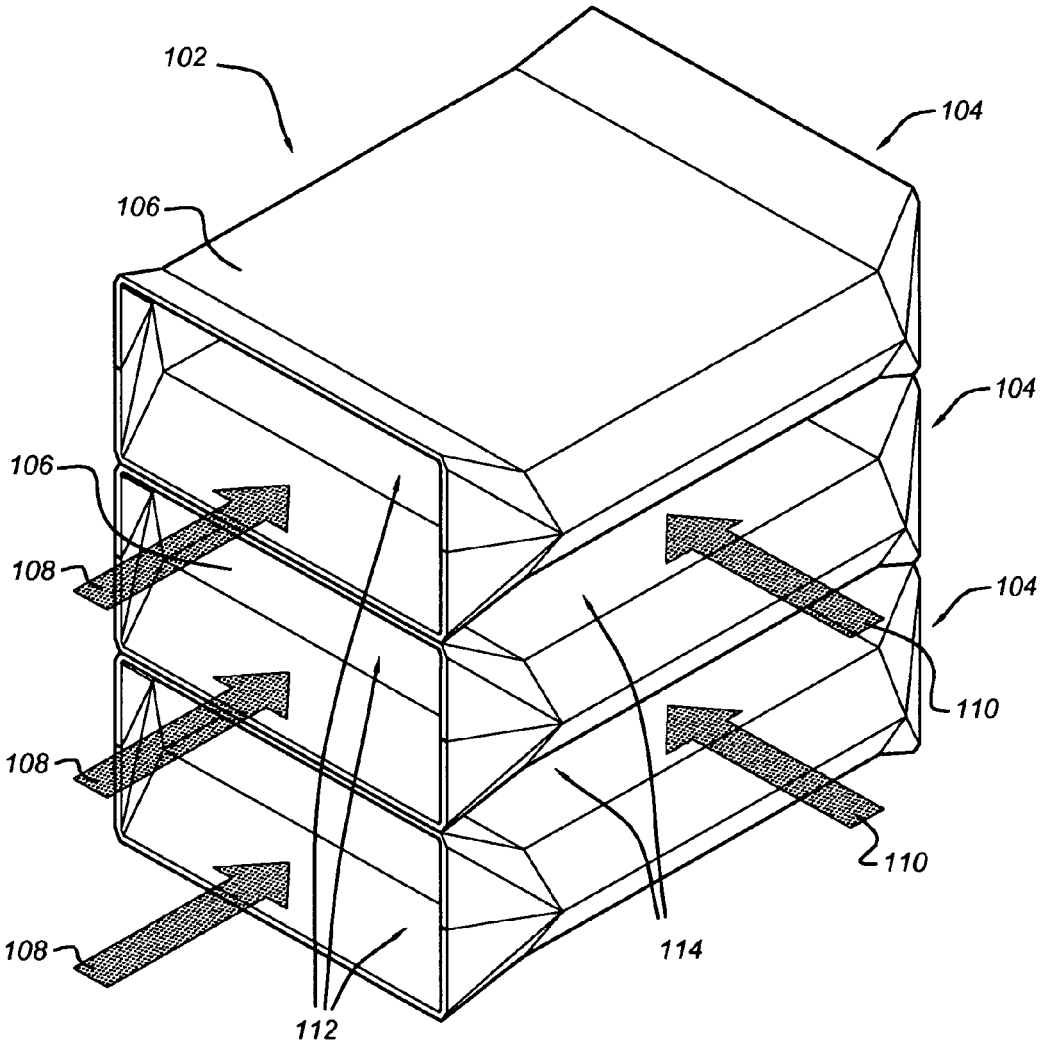
FIG. 1 schematically shows a perspective view of a heat exchanger assembly.

FIG. 1 schematically shows a perspective view of a heat exchanger assembly 102, composed of a plurality of heat exchanger plates 106. The heat exchanger assembly 102 shown in the figure has apparent rectangular symmetries. The individual heat exchanger plates 106, which may be formed out of plane rectangular blanks, are further explained with reference to FIGS. 2-3. The heat exchanger plate 106 in FIG. 1 has rectangular symmetry, as viewed from the top. This is not required in general, as the heat exchanger plate 106 may be manufactured from a rectangular plate or from a non-rectangular quadrilateral plate.

Alternatively, the heat exchanger assembly 102 can be viewed as being composed of heat exchanger shells 104, which are formed out of pairs of adjacent heat exchanger plates 106. The heat exchanger plates 106 are positioned in an abutting manner; with one of the plates positioned upside down with respect to the other plate. The heat exchanger shell 104 may represent a separate article of manufacture, and is further explained with reference to FIG. 4.

The heat exchanger assembly 102 shown in FIG. 1 is referred to as a cross-flow plate type heat exchanger. The cross-flow heat exchanger has fluid channel apertures 112, 114 which form inlets and outlets for the fluid flows and are alternately located at adjacent faces of the heat exchanger assembly 102. On the inside, the heat exchanging assembly 102 has fluid channels 108, 110 that allow passage to the heat exchanging fluids. Here, these fluid channels 108, 110 are arranged in a mutually crossing configuration. In the configuration shown in FIG. 1, the heat exchanger assembly has first fluid channels 108 that are perpendicular to the second fluid channels 110, although other channel configurations are conceivable.

In the embodiment shown in FIG. 1, the first fluid channel apertures 112 have a rectangular shape. The technique for obtaining rectangular first fluid channel apertures 112 provided here may equally well be applied to other known basic types of heat exchanger, which may be based on concurrent or counter flow principles. A U-type concurrent or counter flow construction has remote fluid channel inlets and outlets belonging to a single fluid channel, which are located on the same face of the heat exchanger assembly. Alternatively, a Z-type concurrent or counter flow heat exchanger has fluid channel inlets and outlets belonging to a single fluid channel, which are located on remote portions of opposite faces of the heat exchanger assembly. A description of these heat exchanger types as such can for example be found in patent documents WO 92/09859 and WO 96/19708.

Figure 2A:
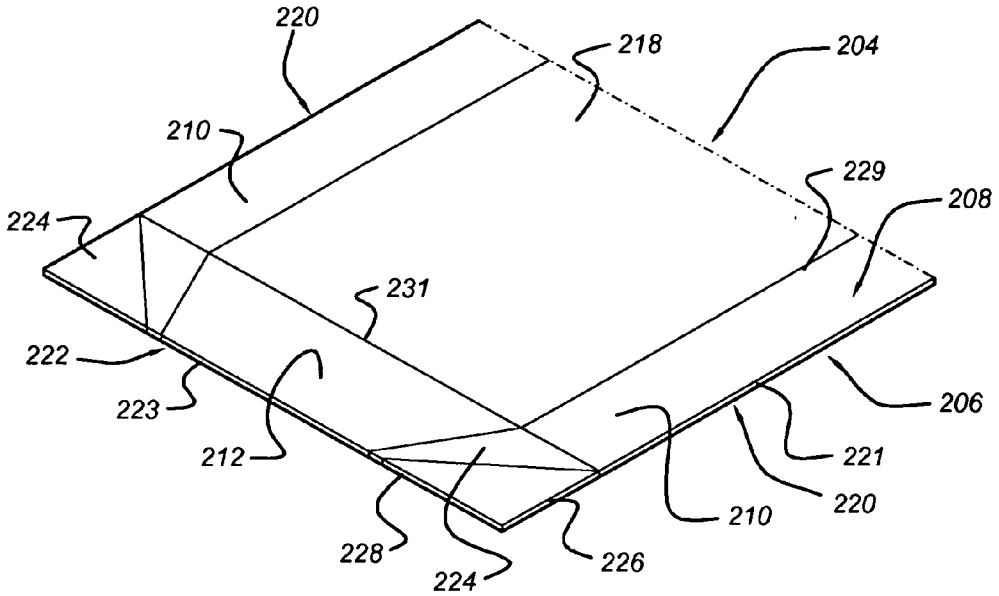
FIG. 2A schematically shows a perspective view of a rectangular plate used to form a heat exchanger plate according to an embodiment.

FIG. 2A schematically shows a perspective view of a rectangular plate 204 of which an embodiment of the heat exchanger plate 106 may be formed. The two opposing faces of the rectangular plate 204 define a first side 206 and a second side 208 of the plate. The circumference of the rectangular plate 204 consists of a pair of opposing first plate edges 220 and a pair of opposing second plate edges 222. Elongated surface patches located near first and second middle edge portions 221, 223 of the rectangular plate 204 constitute first surface portions 210 and second surface portions 212.

Figure 2B:
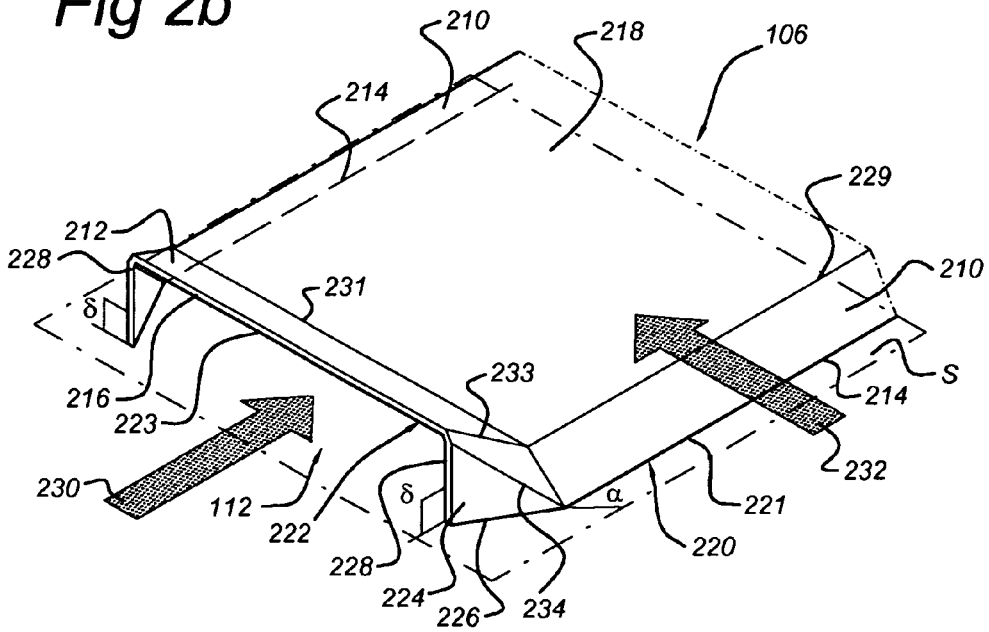
FIG. 2B shows a perspective view of an embodiment of the heat exchanger plate with bent corner and edge surface portions.

FIG. 2A only shows a single second surface portion 212 and corresponding second plate edge 222, in correspondence with the bent heat exchanger plate 106 shown in FIG. 2B. It is understood that a second surface portion 212 and second plate edge 222 may also be present at the rear end of the rectangular plate 204 and the heat exchanger plate 106 shown in FIGS. 2A and 2B respectively.

Corner surface portions 224 are located in the remaining regions along the first and second plate edges 220, 222 that are next to the first and second surface portions 210, 212. The plate edge portions bordering a corner surface portion are referred to as a first corner edge portion 226 and a second corner edge portion 228, both being continuations of the first and second middle edge portions 221, 223 respectively.

The remaining region of the rectangular plate, not covered by the surface and/or corner portions 210, 212, 224, is referred to as the main surface portion 218.

The heat exchanger plates 106 may be manufactured from metallic sheet materials, e.g. carbon steel or alloy steel, with sufficient ductility to allow the forming as described. In order to have some margin while shaping the heat exchanger plates 106, it is preferable that the construction material also allows for a certain amount of irreversible deformation during the forming process. Materials commonly used in manufacturing the plates may allow for plastic deformations of up to 10%-30%.

FIG. 2B shows a heat exchanger plate 106 resulting from the bending of several surface portions of the rectangular plate 204. The heat exchanger plate 106 is formed by bending the first surface portions 210 towards the first side 206 of the rectangular plate 204. This bending will yield a first groove or first partial fluid channel 230 on the first side 206 of the rectangular plate 204. This first partial fluid channel 230 is bounded by the main surface portion 218 and the bent first surface portions 210.

In addition, the second surface portions 212 are bent to the second side 208 of the rectangular plate 204, yielding a second groove or second partial fluid channel 232 on the second side 208. This second partial fluid channel 232 is bounded by the main surface portion 218 and the bent second surface portions 212.

Each first and second surface portion 210, 212 of a heat exchanger plate 106 has a corresponding first or second contacting region 214, 216 representing a line or surface patch suitable for joining with a similar contact region of a second heat exchanger plate. In the example shown in FIG. 2B the heat exchanger plate 106 has first contacting regions 214 coinciding with the respective first middle edge portions 221.

A finalized heat exchanger plate 106 has first contacting regions 214 that are coplanar, defining a plane S. This plane S establishes a reference with respect to which the measures for obtaining regularly shaped first fluid channel apertures 112 can be clearly defined.

The corner surface portions 224 of the finalized heat exchanger plate 106 are bent inward with respect to the first partial fluid channel 230, such that the first corner edge portions 226 are mainly in the plane S. The second corner edge portions 228 in the finalized heat exchanger plate 106 are substantially perpendicular to the plane S.

The substantially perpendicular quality of the respective second corner edge portions 228 implies that the second corner edge portion 228 is oriented at a corner edge angle $\delta$ of approximately 90° with respect to the plane S defined by the coplanar first contacting regions 214, i.e. that the second corner edge portion 228 is parallel to a normal vector of the plane S. The perpendicular corner edge angle $\delta$ is shown in FIG. 2B.

This perpendicular character is subject to manufacturing tolerances, which may be in the range of 5-10%, but are preferably smaller than 5%.

A deviation $d\delta$ from perpendicularity for a selected corner edge portion of a selected heat exchanger plate will require manufacturing of an abutting heat exchanger plate having an adjoining corner edge portion with a complementary deviation from the normal, in order for the selected corner edge portion and the adjoining corner edge portion to be in line, and for first fluid channel aperture 112 to remain regular quadrilateral in shape. In other words, if the deviation $d\delta$ for the selected corner edge portion results in a corner edge angle $\delta=90°+d\delta$, then the adjoining corner edge angle equals $90°-d\delta$. If this complementarity is not obeyed, then the first fluid channel aperture 112 of the heat exchanger shell 104 formed by the abutting heat exchanger plates 106 will obtain an undesirable non-quadrilateral (e.g. a hexagonal) shape. Preferably, the deviation do equals 0°.

In the embodiment shown in FIG. 2B, the first corner edge portion 226 is tilted at a first angle $0°<\alpha<90°$ with respect to the first middle edge portion 221. The value of this angle $\alpha$ depends on the selected sizes and orientations of the various surface regions. In order to have the second corner edge portion 228 substantially perpendicular to the plane S, the first angle $\alpha$ is greater than 0°. The finite sizes of the first and second surface portions 210, 212 require that the first angle is smaller than 90°. Preferably, the first angle $\alpha$ is in the range $5°<\alpha\leq30°$, in order to achieve a smooth flow distribution at the entrance into and the exit from the respective first fluid channels 108.

Furthermore, in this embodiment the bent first and second surface portions 210, 212 are created by folding along corresponding first and second folding lines 229, 231 in the plane of the rectangular plate 204. This first folding line 229 is located in between the first surface portion 210 and the main surface portion 218, while the second folding line 231 is located between the second surface portion 212 and the main surface portion 218.

The geometry of the resulting folded heat exchanger plate shown in FIG. 2B further infers that an additional folding line 233 is required, connecting a point on the second plate edge 222 with an intersection of the first folding line 229 and the second folding line 231. In this configuration, the corner surface portions 224 of the heat exchanger plate 106 are also folded along a diagonal folding line 234 connecting an intersection of the additional folding line 233 and the second plate edge 222 with an intersection of the second folding line 231 and the first plate edge 220.

According to alternative embodiments, the first surface portions 210 may be flat folded surface patches perpendicular to the plane S or may be curvedly bent regions. In the latter case, the additional folding line 233 and diagonal folding line 234 are not required.

The heat exchanger plate 106 may have a second partial fluid channel 232 that is substantially perpendicular to the first partial fluid channel 230. This perpendicular property may be present irrespective of the geometry, which may be folded and polygonal as in FIG. 2B, or may be curvedly bent.

As was already mentioned, the heat exchanger plates 106 may also be constructed of plates having a non-rectangular quadrilateral shape. The first and second partial fluid channels 230, 232 are not required to be perpendicular in this case. The asymmetric quadrilateral plate configuration is only subject to the restriction that the first contacting regions 214 still span the plane S.

Figure 3A:
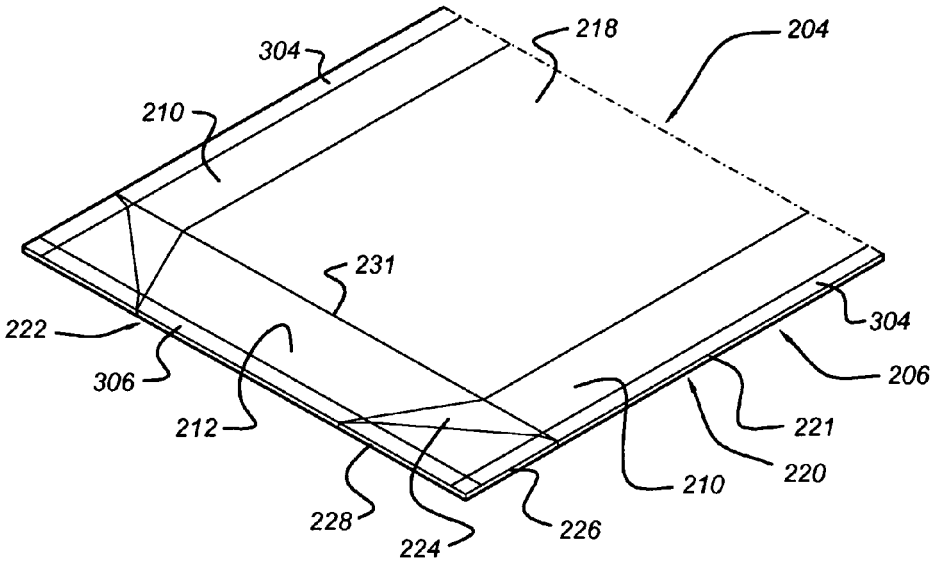
FIG. 3A schematically shows a perspective view a rectangular plate used to form a flanged heat exchanger plate according to another embodiment.
Figure 3B:
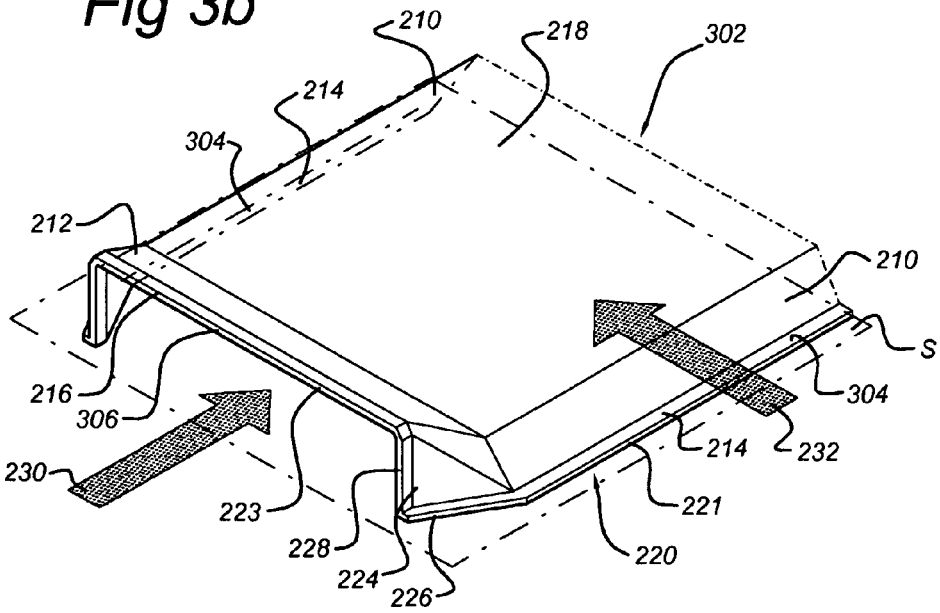
FIG. 3B shows a perspective view of another embodiment of the heat exchanger plate with bent corner surface portions and flanges.

FIG. 3A schematically shows a perspective view a rectangular plate 204 used to form a flanged heat exchanger plate 302 according to FIG. 3B. Again, the second surface portion 212 and second plate edge 222 located on the rear side of the plate are not shown. At least one of the first surface portions 210 of the flanged heat exchanger plate 302 may comprise a first flange 304 near the corresponding first plate edge 220.

The first flange 304 may be present along the entire first plate edge 220, that means along both the first middle edge portion 221 and the first corner edge portions 226, as shown in FIG. 3B. Alternatively, at least one first surface portion 210 may comprise a first flange 304 being mainly located along the first middle edge portion 221 while gradually receding into the corner surface portion 224. In this case, the first flange 304 merges with a flangeless first corner edge portion 226. Such transitions in flanged heat exchanger plates 302 may be manufactured from plate blanks having plastic deformable properties, as previously described.

Alternatively or in addition to the first flange 304, at least one of the second surface portions 212 of the flanged heat exchanger plate 302 may have a second flange 306 near the corresponding second middle edge portion 223. FIG. 3B shows an embodiment of a flanged heat exchanger plate 302 including first and second flanges 304, 306. The formation of the first and second partial fluid channels 230, 232 is similar to the embodiment shown previously in FIG. 2B. The first flange 304 includes the first contacting region 214, which together with the remaining first contacting region of the flanged heat exchanger plate 302 defines the plane S. In FIG. 3B, the entire first flange 304 lies in the plane S and entirely coincides with the first contacting region 214. Alternatively, the first flange 304 may have a first flange portion 310 that is bent such that it is tilted with respect to the plane S, which is further explained with reference to FIG. 5.

Figure 4:
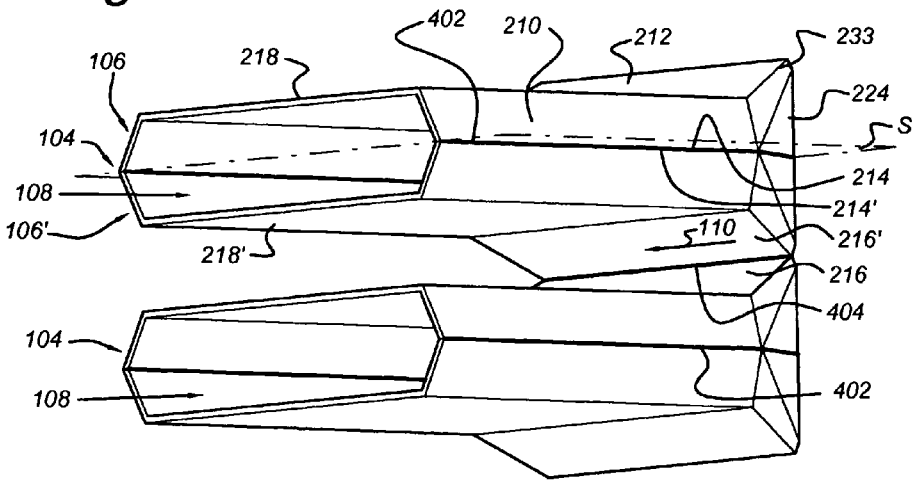
FIG. 4 presents a perspective cross sectional view of a stacked pair of heat exchanger shells according to an embodiment.

FIG. 4 presents a perspective cross sectional view of a stacked pair of heat exchanger shells 104 according to an embodiment. A single heat exchanger shell 104 comprises heat exchanger plates 106, 106' that are joined along their respective first contacting regions 214, 214'. In general, these first contacting regions 214, 214' may comprise one or more of the following elements selected from the first middle edge portions 221, the first corner edge portions 226 and/or the first flanges 304 possibly excluding the tilted first flange portions 310. These elements were illustrated in the previous figures. In order to reduce or eliminate the fluid leaking to the environment, it is preferred that the first contacting regions 214, 214' of the heat exchanger plates 106, 106' are sealed. The first contacting regions 214, 214' may be partially or entirely sealed by first sealing joints 402 between the heat exchanger plates 106, 106'. Analogously, the second contacting regions 216, 216' may be connected by second sealing joints 404. These sealing joints 402, 404 may for example be achieved by welding, brazing or clamping of the heat exchanger plates along their respective first and/or second contacting regions. Methods of joining the plates are further explained with reference to FIG. 5.

According to an embodiment, the heat exchanger plate 106 may have an essentially flat first surface portion 210 that is tilted at a second angle β with respect to the plane S. This second angle β may be in the range $0° < \beta \leq 135°$. The case $\beta = 90°$ represents a first surface portion 210 that is perpendicular to the plane S. The unrealistic value $\beta = 0°$ represent an asymptotic limit, resulting in a first fluid channel 108 with vanishing height and a lack of spacing between the main surface portions 218, 218' of adjacent heat exchanger plates 106, 106'. For the cases $\beta < 90°$ shown in FIG. 4, the first surface portions 210, 210' are inclined with respect to the plane S, resulting in a first fluid channel 108 with a regular hexagonal shape. The range $90° \leq \beta \leq 135°$ similarly yields a hexagonal shape with first surface portions that are folded inward with respect to the first fluid channel 108. In both such configurations, the corner surface portions 224 of the heat exchanger plate may be folded along the additional folding lines 233. This second angle β may preferably be in the range $30° \leq \beta \leq 135°$, in order to maintain a heat exchanger shell 104 with first surface portions 210 that are not excessively protruding or sharp near the edges.

Alternatively, a heat exchanger plate 106 may have first and/or second surface portions 210, 212 that are curvedly bent, as is explained with reference to FIGS. 5A-5E. In such cases, the first surface portion 210 is not a folded planar region, rendering the concept of the second angle β less useful. Here, a ratio between the height H of the first partial fluid channel and the projected width W of the first surface portion onto the plane S is more appropriate. For the same reason given above, the ratio H/W for outwards projecting first surface portions 210 is preferably larger than $1/\sqrt{3}$. The upper bound for H/W cannot be given, but corresponds to a curved first surface portion 210 configuration that converges to the perpendicular configuration shown in FIG. 5A.

Figure 5A:
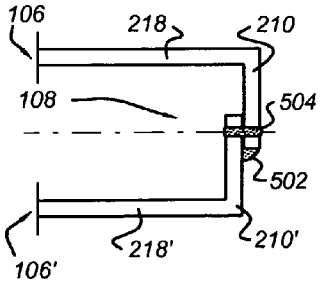
FIG. 5A-5J present embodiments of the heat exchanger plates with different first surface region curvatures and first flanges.
Figure 5B:
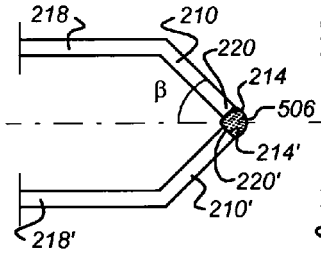
Figure 5C:
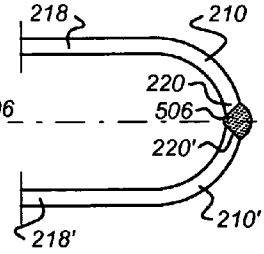
Figure 5D:
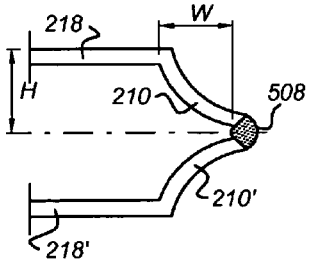
Figure 5E:
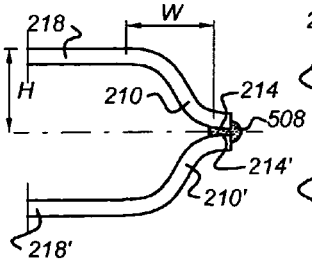
Figure 5F:
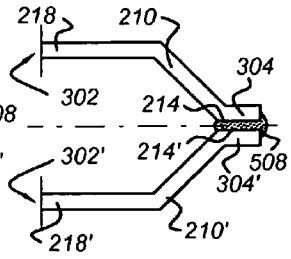
Figure 5G:
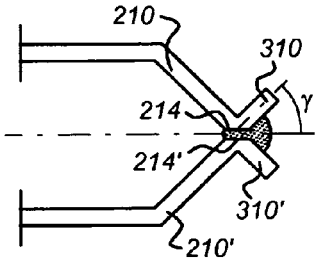
Figure 5H:
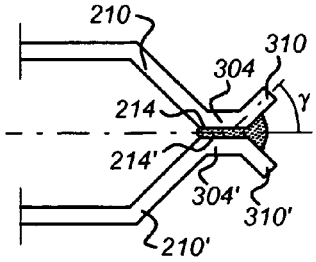
Figure 5I:
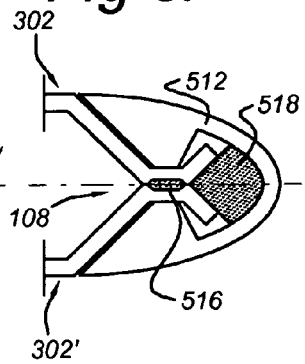

FIGS. 5A-5J present partial cross sections of the first fluid channel 108 for various embodiments of the heat exchanger shell. FIGS. 5A-5E focus on the shape of the first surface portions 210, 210' of two abutting heat exchanger plates 106, 106'. In accordance to the adopted meaning of the terms "bending" or "folding" previously explained, the first surface portions 210, 210' may be bent in various ways, resulting in various shapes. Shown shapes for the first surface portions 210, 210' are planar and perpendicular (FIG. 5A), planar and tilted (FIG. 5B), concave (FIG. 5C), convex (FIG. 5D), and sinusoidal (FIG. 5E). Furthermore, FIGS. 5A-5J illustrate various shapes for the contacting regions 214, 214' of adjacent heat exchanger plates 106, 106', 302, 302' as well as the methods of attaching adjacent plates. These first contacting regions 214, 214' may be formed by the first plate edges 220, 220' (FIGS. 5A-5E), by the entire first flanges 304, 304' (FIG. 5F), or by regions of the first flanges 304, 304' that exclude the first flange portions 310, 310' (FIGS. 5G-5I).

As is shown in FIGS. 5G-5I, the first flange 304 may have a first flange portion 310 that is bent such that it is tilted with respect to the plane S. The tilted first flange portion 310 will not lie in the plane S and therefore does not coincide with the first contacting region 214. A tilt between the plane S and the first flange portion 310 may be described by a third angle γ. The third angle γ is restricted to the range $0° < \gamma < 180°$. The upper bound of this range may be further limited by the possibility of physical contact between the first flange portion 310 and the first surface portion 210.

The selected shape of a first surface portion 210 dictates the geometric transition from this first surface portion 210 to the folded corner surface portion 224 of a heat exchanger plate 106, 302. The transition may be gradually curved or it may be more like the polygonal heat exchanger plate configuration as shown in FIGS. 2B and 3B.

Moreover, it is possible for two abutting heat exchanger plates to have different shapes.

Connecting and sealing of the first and second contacting regions 214, 216 may be achieved by conventional methods, such as welding and brazing. Known welding methods which are shown here yield a fillet weld 502, a plasma or electric resistance weld 504 (FIG. 5A), a groove weld 506 (FIGS. 5B and 5C), an edge weld 508 (FIGS. 5D and 5E) or a butt weld (not shown).

It is furthermore known that the welding quality can be improved by removing some plate material from contacting regions 214, 216, such as to form a welding groove along these contacting regions. As illustrated in FIGS. 5F-5H, the provision of flanges 304 increases the area of the contacting regions 214, presenting an accessible shoulder for applying the edge weld 508. Many more known edge sealing techniques can be employed, as will be obvious to a welding specialist.

Figure 5J:
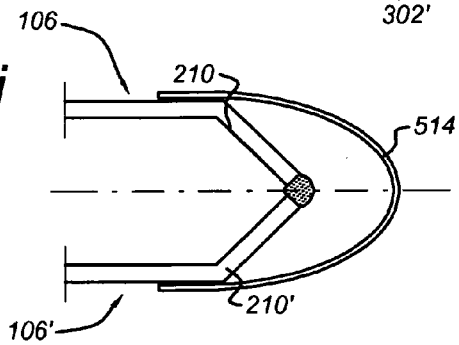

A pair of adjacent heat exchanger plates 106, 302 may be provided with an edge clamp 512 or a flow guiding element 514, as is shown in FIG. 5I and FIG. 5J respectively. The edge clamp 512 or flow guiding element 514 may be located on an adjoining pair of first surface portions 210, 210' of the two adjacent heat exchanger plates 106, 106', 302, 302'.

For heat exchanger plates 106, 302 that are welded together, a flow guiding element 514 is not required to have a high mechanical stiffness, as the main purpose of the flow guiding element 514 will be to guide the flow into the fluid channels 108, 110.

For non-welded heat exchanger plates 106, 302 it may be desired to apply edge clamps 512 or more rigid flow guiding elements 514. In the latter case, an additional function of the flow guiding element 514 is to hold the plates together and to prevent leakage from and into the fluid channels 108, 110. This is shown in FIG. 5I. The edge clamp 512 also serving as a flow guiding element 514 is attached along the first surface portions 210, 210' and may be of an elastic material, like spring steel. An attached edge clamp 512 compresses the heat exchanger plates along the first contacting regions 214, 214'. A gasket 516 may be applied along and in between the first contacting regions, in order to improve the sealing of the first fluid channel 108. Furthermore, sealing material 518 may be applied along and to the side of the first contacting regions, preferably being enveloped by the edge clamp 512. As the geometry of the heat exchanger shell changes near the corner surface portions 224, a permanent attachment (e.g. welding or brazing) of the first contacting regions 214 may be preferred over edge clamps 512 or flow guiding elements 514 here.

Although not illustrated in the figures, the second surface portions 212 may also be curved analogously to the illustrations in FIG. 5. Furthermore, the measures described above for joining the heat exchanger plates along their respective first contacting regions 214 may also be applied to the second contacting regions 216 of two heat exchanger plates or shells. The method of joining may be applied along any of the contacting regions 214, 216 and in any desired combination.

Figure 6:
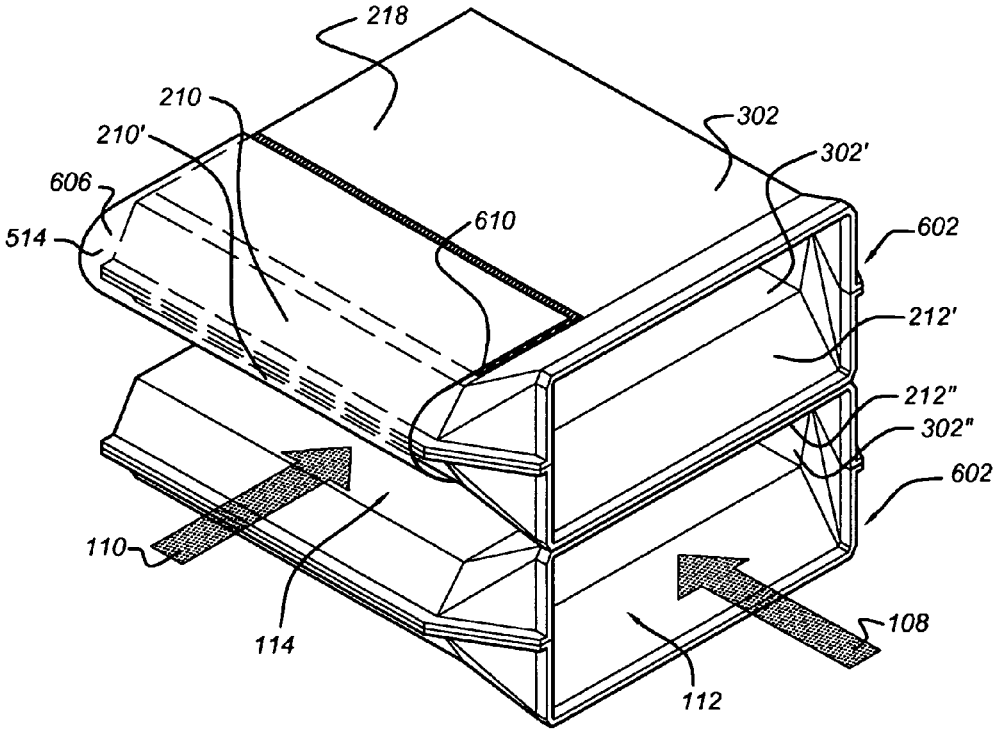
FIG. 6 presents a perspective view of a stacked pair of flanged heat exchanger shells according to an embodiment.

FIG. 6 presents a perspective view of a stacked pair of flanged heat exchanger shells 602. One of the flanged heat exchanger shells 602 shown is provided with a flow guiding element 514 that is located on an adjoining pair of first surface portions 210, 210' of two abutting flanged heat exchanger plates 302, 302'.

Multiple flow guiding elements 514 may be installed on the available first surface portions 210 in this way. Alternatively or in addition, one or more flow guiding elements 514 may be provided on an adjoining pair of second surface portions 212', 212" of two adjacent flanged heat exchanger plates 302', 302".

The flow guiding element 514 may be an ordinary flow guide, which guides the fluid flow into or out of the fluid channels 108, 110 while reducing the flow separation.

Alternatively, the flow guiding element 514 may be a ferrule 606, which is a thin curved plate enveloping a pair of adjacent surface portions 210, 210' or 212', 212", preferably provided on the inlet first or second fluid channel apertures 112,114. This ferrule 606 near the inlet fluid channel apertures 112,114 extends a certain distance into the inlet fluid channel apertures 112,114. A thermally insulating gap filled with stagnant fluid found within the respective fluid channel may be provided between the ferrule 606 and the main surface portions 218 of the flanged heat exchanger plates 302, in order to protect the main surface portions and fluid channel apertures from direct contact with the fluid entering the fluid channels. Additionally, this thermally insulating gap may be filled with an insulating material 610, such as ceramic fibre paper, in order to increase the insulation efficiency. This prevents surfaces and edges to be excessively cooled or heated due to the incoming fluid flow.

Also, the flow guiding element 514 may be a convergent nozzle (not shown), which is also attachable near the inlet fluid channel apertures and extending a certain distance into the fluid channels. Furthermore, the nozzle wall converging into the fluid channel is able to generate a jet from the incoming fluid stream.

In summary, any of these flow guiding elements 514 may be provided on at least one of an adjoining pair of first surface portions 210, 210' and an adjoining pair of second surface portions 212', 212" of two adjacent heat exchanger plates.

Figure 7A:
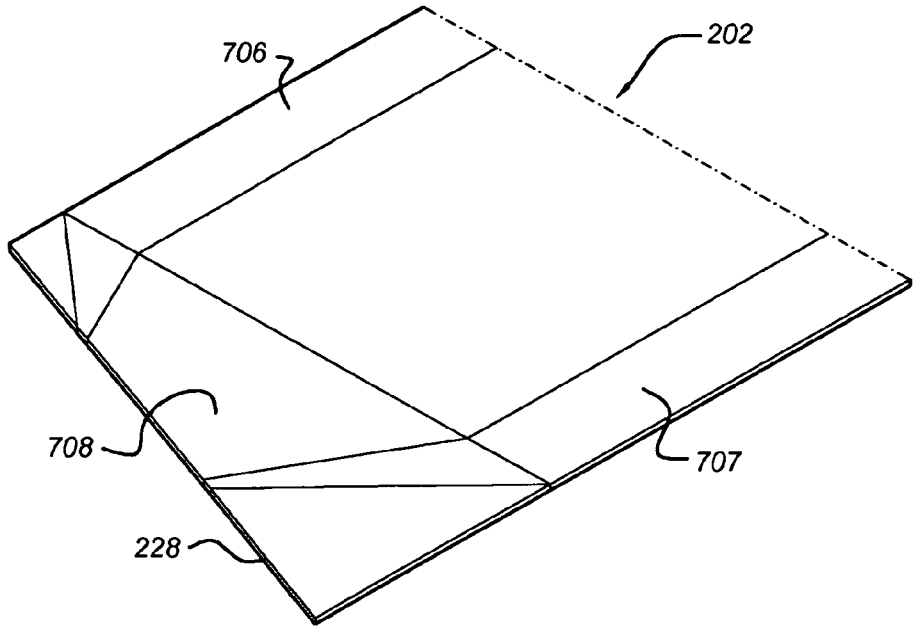
FIG. 7A schematically shows a perspective view a quadrilateral plate used to form an asymmetric heat exchanger plate according to another embodiment.
Figure 7B:
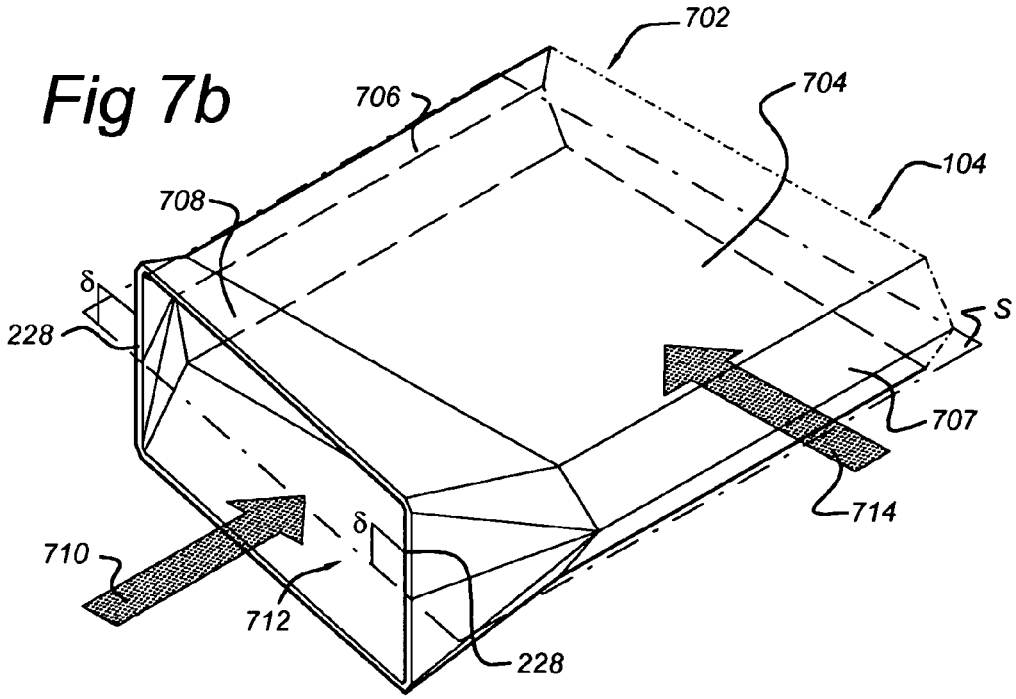
FIG. 7B shows a perspective view of an asymmetric heat exchanger plate according to another embodiment.

FIG. 7B shows an embodiment of a heat exchanger shell 104 composed of asymmetric heat exchanger plates 702 each having a tilted main surface portion 704. As a consequence, the heat exchanger shell 104 has an irregular first fluid channel 710 with a hexagonal cross section and a varying height along the width of this channel. The tilt of the tilted main surface portion 704 may be achieved by providing a broad first surface portion 706 and a small first surface portion 707 that differ in their respective widths, as can be seen in FIGS. 7A and 7B. The embodiment shown has a quadrilateral second surface portion 708, which varies in size along the width of the non-rectangular quadrilateral plate 202 that is used for forming the asymmetric heat exchanger plate 702. Again, the quadrilateral second surface portion 708 at the rear of the plate is not shown. Consequently, the reduction in height of the irregular first fluid channel 710 is compensated for by the varying size of the quadrilateral second surface portions 708, such that a resulting rectangular first fluid channel aperture 712 is indeed rectangular.

In FIG. 7B, the substantially perpendicular quality of the respective second corner edge portions 228 is again indicated by the corner edge angle $\delta$ of 90° with respect to the plane S.

A plane defined by the rectangular first fluid channel aperture 712 is slanted with respect to the irregular first fluid channel 710, instead of being perpendicular as was shown in FIG. 1.

Alternatively or in addition, the irregular first fluid channel 710 may be given a varying cross section along its length in an analogous way. Even more, the dimensions of the cross section of an irregular second fluid channel 714 may vary along its length. Such variation of the dimensions along the irregular fluid channels 710, 714 may be used to correct for unfavourable temperature distributions within the heat exchanging fluids.

Besides varying the dimensions of the surface portions 704-708 along the corresponding partial fluid passages, the variation of dimensions of the channel cross sections may also be achieved by varying the curvature of the first and/or second surface portions 706-708 along the same fluid channels. In general, fluid channels may be created with converging, diverging or otherwise non-uniform cross sections along their lengths.

According to an aspect, a method for manufacturing a heat exchanger plate 106 is provided. In general, the heat exchanger plate is manufactured from a quadrilateral plate 202 having a pair of opposing first plate edges 220 and a pair of opposing second plate edges 222. The method comprises bending of first surface portions 210, each of which is located along a first middle edge portion 221 of a first plate edge 220, to a first side of the quadrilateral plate 202. This yields a first groove or first partial fluid channel 230. Consequently, each first surface portion 210 will have a first contacting region 214. The method further comprises bending of second surface portions 212, each of which is located along a second middle edge portion 223 of a second plate edge 222, to a second side of the quadrilateral plate 202. This will result in a second groove or second partial fluid channel 232 and in each second surface portion 212 obtaining a second contacting region 216. After these bending operations, the first contacting regions are coplanar and jointly define a plane S. The heat exchanger plate 106 has four corner surface portions 224 each comprising a first corner edge portion 226 and a second corner edge portion 228. The method is characterized by the fact that at least two corner surface portions 224 are bent inward with respect to the first partial fluid channel 230 such that the respective first corner edge portion 226 will end up in the plane S, while the respective second corner edge portions 228 will end up being substantially perpendicular to the plane S.

According to an embodiment, the bending of at least one of the first surface portions 210 further results in this first surface portion being tilted at an angle β with respect to the plane S. This angle may be in the range $0° < \beta \leq 135°$. In addition, at least one of the at least two corner surface portions 224 may be bent along an additional folding line 234 connecting the respective first corner edge portion 226 and the second corner edge portion 228.

According to an embodiment, at least one first middle edge portion 221 of the quadrilateral plate 202 is bent to the first side 206 of the heat exchanger plate 106, resulting in at least one first contacting region 214 coinciding with the respective first middle edge portion 221.

According to another embodiment, at least one first surface portion 210 of the quadrilateral plate 202 comprises a first flange 304 near the corresponding first middle edge portion 221. After bending of the first surface portion 210 to the first side 206 of the heat exchanger plate 106, the first flange 304 is also bent. At least a portion of the first flange 304 will lie in the plane S and will include the first contacting region 214.

According to another embodiment, at least one second surface portion 212 of the quadrilateral plate 202 comprises a second flange 306 near the corresponding second middle edge portion 223. After bending of the second surface portion 212 to the second side 208 of the heat exchanger plate 106, the second flange 306 is also bent. At least a portion of the second flange 306 will include the second contacting region 216.

The descriptions above are intended to be illustrative, not limiting. It will be apparent to the person skilled in the art that alternative and equivalent embodiments of the invention can be conceived and reduced to practice, without departing from the scope of the claims set out below.

LIST OF FIGURE ELEMENTS

102 heat exchanger assembly
104 heat exchanger shell
106 heat exchanger plate
108 first fluid channel
110 second fluid channel
112 first fluid channel aperture
114 second fluid channel aperture
202 quadrilateral plate
204 rectangular plate
206 first side
208 second side
210 first surface portion
212 second surface portion
214 first contacting region
216 second contacting region
218 main surface portion
220 first plate edge
221 first middle edge portion
222 second plate edge
223 second middle edge portion
224 corner surface portion
226 first corner edge portion
228 second corner edge portion
229 first folding line
230 first partial fluid channel
231 second folding line
232 second partial fluid channel
233 additional folding line
234 diagonal folding line
S plane
δ corner edge angle
α first angle
302 flanged heat exchanger plate
304 first flange
306 second flange
308 corner flange portion
310 first flange portion
312 second flange portion
402 first sealing joint
404 second sealing joint
β second angle
502 fillet weld
504 plasma weld
506 groove weld
508 edge weld
510 butt weld
512 edge clamp
514 flow guiding element
516 gasket
518 sealing material
H height
W projected width
γ third angle
602 flanged heat exchanger shell
606 ferrule
608 convergent nozzle
610 insulating material
702 asymmetric heat exchanger plate
704 tilted main surface portion
706 broad first surface portion
707 small first surface portion
708 quadrilateral second surface portion
710 irregular first fluid channel
712 rectangular first fluid channel aperture
714 irregular second fluid channel

The invention claimed is:

1. A heat exchanger plate formed from a quadrilateral plate having a pair of opposing first plate edges and a pair of opposing second plate edges, the heat exchanger plate comprising:

first surface portions each along a first middle edge portion of a first plate edge, each first surface portion including a first contacting region;

second surface portions each along a second middle edge portion of a second plate edge, each second surface portion including a second contacting region;

at least two corner surface portions including a first corner edge portion and a second corner edge portion, which form continuations of the corresponding first middle edge portion and the second middle edge portions respectively;

wherein the first surface portions are bent to a first side of the quadrilateral plate resulting in a first partial fluid channel, and the second surface portions are bent to a second side of the quadrilateral plate resulting in a second partial fluid channel;

wherein the first contacting regions extend along coplanar edge lines defining a plane; and wherein the at least two corner surface portions are bent inward towards the first partial fluid channel and away from the first surface portion such that the first corner edge portions are in the plane and tilted at a non-zero angle α in the range $0° < \alpha < 90°$ with respect to the corresponding edge line, while the respective second corner edge portions are substantially perpendicular to the plane.

2. The heat exchanger plate according to claim 1, in which at least one of the first surface portions is tilted at an angle β with respect to the plane, the angle β being in the range $0°<\beta<135°$.

3. The heat exchanger plate according to claim 1, in which the quadrilateral plate is a rectangular plate, and in which the second partial fluid channel is substantially perpendicular to the first partial fluid channel.

4. The heat exchanger plate according to claim 1, in which at least one first contacting region comprises the respective first middle edge portion.

5. The heat exchanger plate according to claim 1, in which at least one first surface portion comprises a first flange near the corresponding first middle edge portion, the first flange including the first contacting region.

6. The heat exchanger plate according to claim 1, in which at least one second surface portion comprises a second flange near the corresponding second middle edge portion, the second flange including the second contacting region.

7. The heat exchanger plate according to claim 5, in which a first flange portion of the first flange is bent with respect to the plane, the first flange portion excluding the first contacting region.

8. The heat exchanger plate according to claim 6, in which a first flange portion of the first flange is bent with respect to the plane, the first flange portion excluding the first contacting region.

9. The heat exchanger plate according to claim 1, in which the cross section of at least one of the first and second partial fluid channels varies along the at least one of the first and second partial fluid channels.

10. The heat exchanger plate according to claim 1, in which a main surface portion of the heat exchanger plate is tilted with respect to the plane.

11. A heat exchanger shell comprising:

a pair of heat exchanger plates, wherein each of the heat exchanger plates is formed from a quadrilateral plate having a pair of opposing first plate edges and a pair of opposing second plate edges, and wherein each of the heat exchanger plates includes:

first surface portions each along a first middle edge portion of a first plate edge, each first surface portion including a first contacting region, second surface portions each along a second middle edge portion of a second plate edge, each second surface portion including a second contacting region, and at least two corner surface portions comprising a first corner edge portion and a second corner edge portion, which form continuations of the corresponding first middle edge portion and the second middle edge portion respectively;

wherein the first surface portions are bent to a first side of the quadrilateral plate resulting in a first partial fluid channel, and the second surface portions are bent to a second side of the quadrilateral plate resulting in a second partial fluid channel, wherein the first contacting regions extend along coplanar edge lines defining a plane, and wherein the at least two corner surface portions are bent inward towards the first partial fluid channel and away from the first surface portion such that the first corner edge portions are in the plane and tilted at a non-zero angle α in the range $0°<\alpha<90°$ with respect to the corresponding edge line, while the respective second corner edge portions are substantially perpendicular to the plane; and wherein the heat exchanger plates are connected along their first contacting regions and the first partial fluid channels of the respective heat exchanger plates form a first fluid channel.

12. A heat exchanger assembly comprising a plurality of heat exchanger shells as described by claim 11, in which at least two heat exchanger shells are connected along their second contacting regions, such that one of the second partial fluid channels of a first heat exchanger shell combines with one of the second partial fluid channels of a second heat exchanger shell, forming a second fluid channel.

13. The heat exchanger assembly according to claim 12, wherein at least one flow guiding element is provided on at least one of an adjoining pair of first surface portions and an adjoining pair of second surface portions of two adjacent heat exchanger plates.

14. The heat exchanger assembly according to claim 13, wherein the flow guiding element is a ferrule.

15. A method of manufacturing a heat exchanger plate from a quadrilateral plate having a pair of opposing first plate edges and a pair of opposing second plate edges, the method comprising:

bending of first surface portions each located along a first middle edge portion of a first plate edge to a first side of the quadrilateral plate, resulting in a first partial fluid channel and in each first surface portion comprising a first contacting region;

bending of second surface portions each located along a second middle edge portion of a second plate edge, to a second side of the quadrilateral plate, resulting in a second partial fluid channel and in each second surface portion comprising a second contacting region;

whereby after folding, the first contacting regions extend along coplanar edge lines that define a plane, and whereby the heat exchanger plate comprises corner surface portions comprising a first corner edge portion and a second corner edge portion, which form continuations of the corresponding first middle edge portion and the second middle edge portion respectively; and characterized by:

bending of at least two corner surface portions inward towards the first partial fluid channel and away from the first surface portion such that the first corner edge portions are in the plane and tilted at a non-zero angle α in the range $0°<\alpha<90°$ with respect to the corresponding edge line, while the respective second corner edge portions are substantially perpendicular to the plane.

16. The heat exchanger plate according to claim 1, wherein the non-zero angle α between the first corner edge portion and the corresponding edge line is in the range $5°<\alpha<30°$.

* * * * *